US006158519A

United States Patent [19]

Kretschmer

[11] Patent Number: 6,158,519

[45] Date of Patent: Dec. 12, 2000

[54] FIRE SUPPRESSION METHOD AND APPARATUS

[76] Inventor: Alan P. Kretschmer, 11061 W. Cobb Ave., Hales Corners, Wis. 53214

[21] Appl. No.: 09/485,000

[22] Filed: Jan. 18, 2000

[51] Int. Cl.[7] ..... A62C 35/00

[52] U.S. Cl. ..... 169/16; 169/37; 169/51; 239/209

[58] Field of Search ..... 239/208, 209; 169/5, 16, 43, 46, 51, 37; 248/342, 343; 52/1, 506.08; 285/302

[56] References Cited

U.S. PATENT DOCUMENTS 5,327,976 7/1994 Hattori .
5,396,959 3/1995 Macdonald .
5,570,745 11/1996 MacDonald, III ..... 169/16

*Primary Examiner*—Andres Kashnikow
*Assistant Examiner*—Lisa Ann Douglas
*Attorney, Agent, or Firm*—Joseph S. Heino, Esq.

[57] ABSTRACT

A fire suppression method and apparatus has a sprinkler head support bracket which is installable immediately above a ceiling tile. The support bracket is configured with a plurality of openings such that multiple locations for the sprinkler head may be used and the exact "center of tile" installation of the sprinkler head can be accomplished with a wide variety of suspended ceiling assemblies and sprinkler heads. The support bracket rests on grid support members and arches over the ceiling tile. Hold down clips are provided to maintain the bracket in position relative to the grid support members. A pipe clamp is provided which is insertable within the bracket to retain a drop nipple within it. The drop nipple is adjustable relative to the horizontal to move it upwardly or downwardly relative to the ceiling tile. In this fashion, the vertical location of the sprinkler head can be adjusted depending upon the elevation of the ceiling tiles used and the style of sprinkler head used. The drop nipple is attached to a flexible armover connector which allows for an almost infinite number of locations that can be used to connect the drop nipple to the supply line of the fire suppression system.

12 Claims, 3 Drawing Sheets

FIG. 1
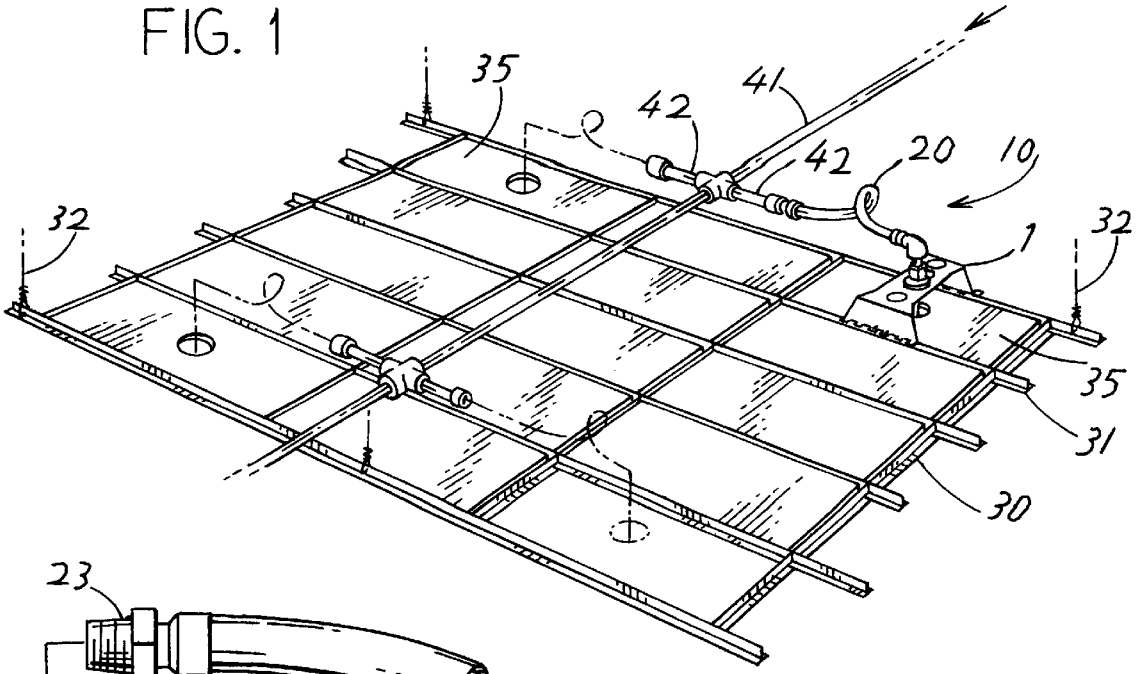
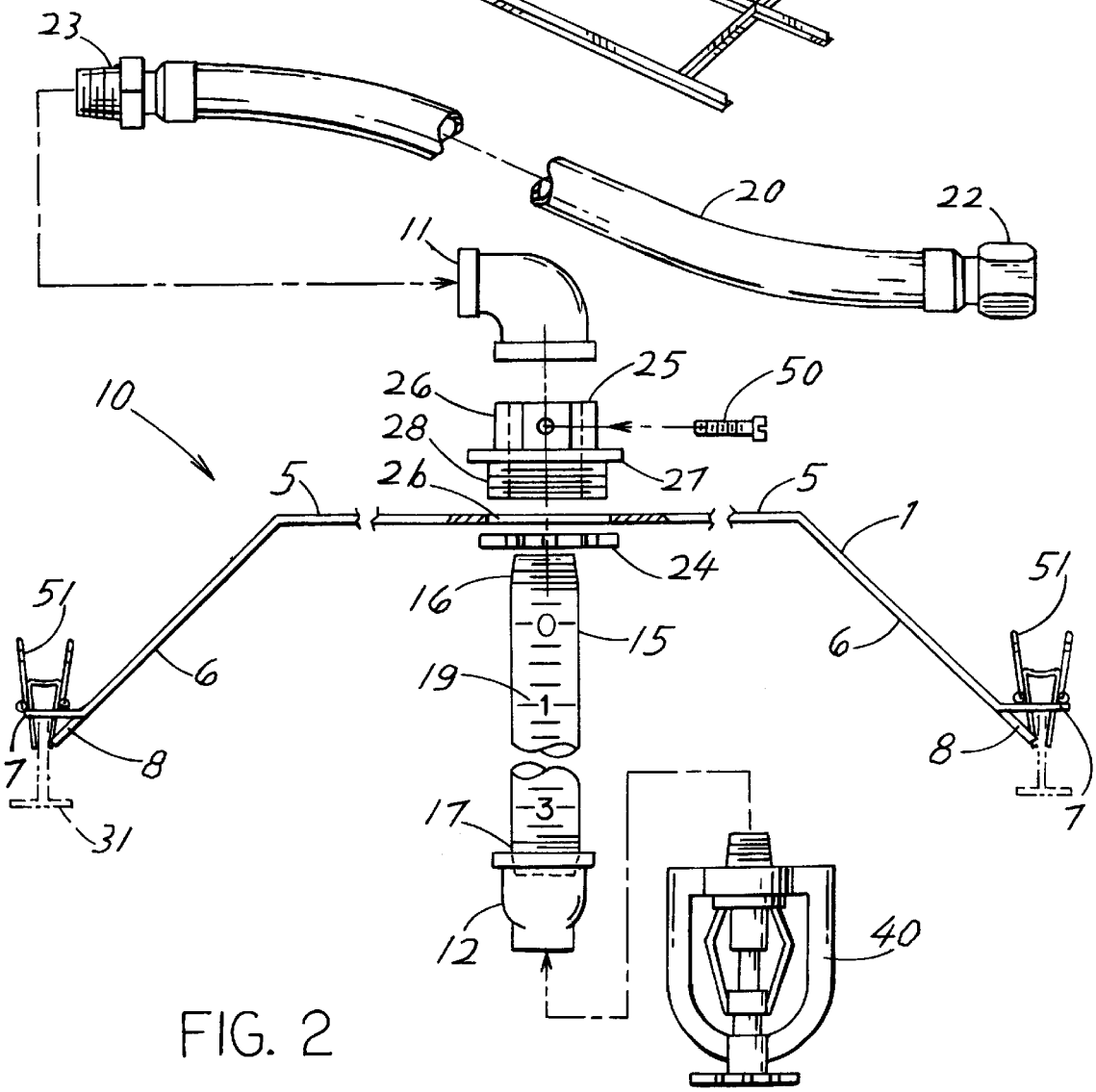
FIG. 2

FIG. 3
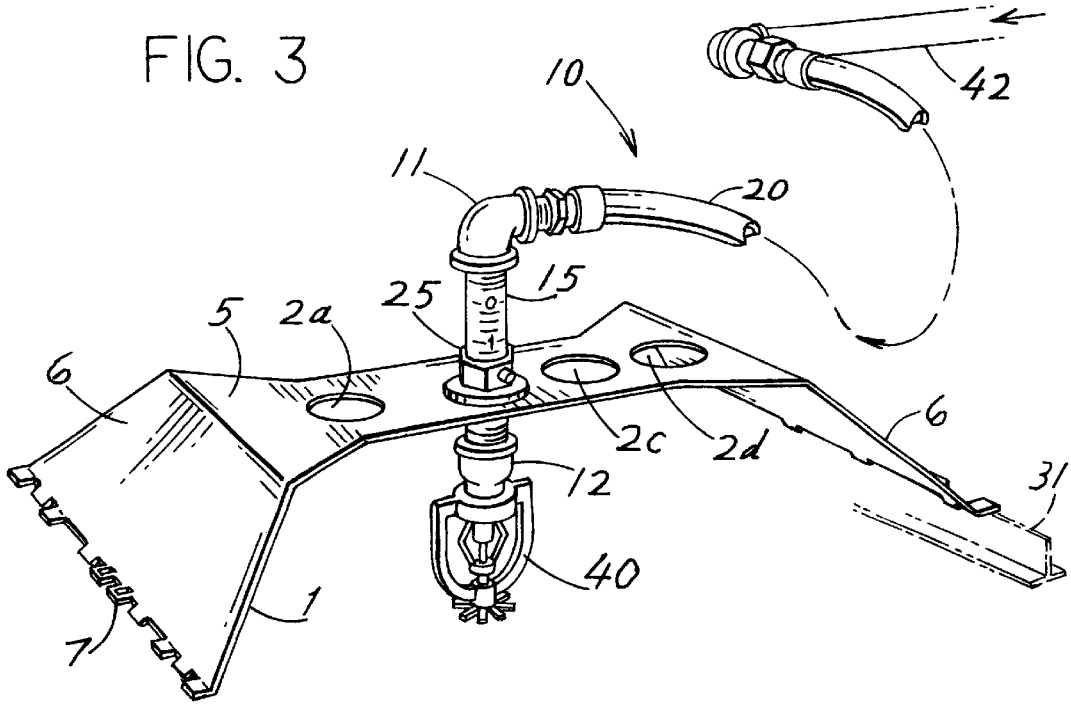
FIG. 4
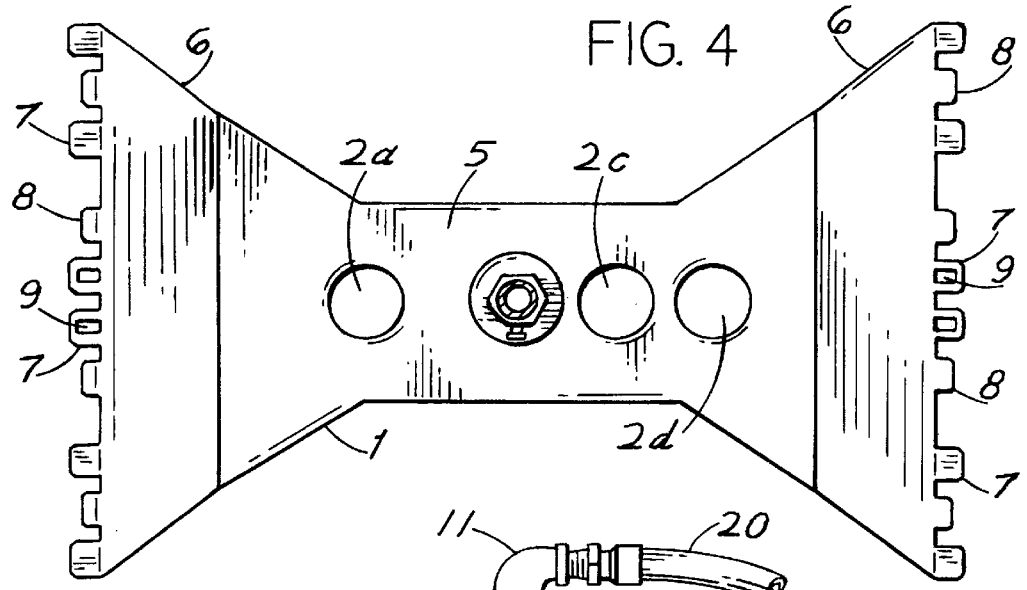
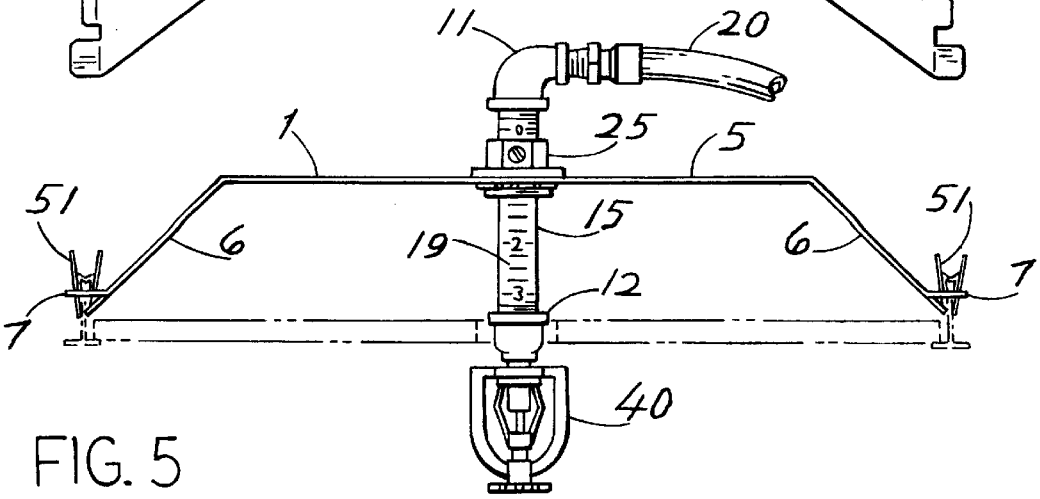
FIG. 5

FIRE SUPPRESSION METHOD AND APPARATUS

FIELD OF THE INVENTION

This invention relates generally to devices and methods which may be used for the suppression of fires, including fire suppression systems which utilize a plurality of sprinkler heads mounted within a suspended ceiling assembly. More particularly, this invention relates to a method for installing sprinkler heads in a "center of tile" array such that the exact "center of tile" installation is accomplished regardless of the location of the supply or feeder lines in relation to the sprinkler heads which are attached to those lines. It also relates to an apparatus or assembly for effecting the exact "center of tile" location and installation of those sprinkler heads in a wide variety of suspended ceiling assemblies and sprinkler head styles.

BACKGROUND OF THE INVENTION

The use of water to suppress or extinguish fires is a concept as old as fire itself. And, quite probably as long as it has inhabited dwellings, mankind has long searched for the best way to effect the distribution of water within dwellings where the risk of death and destruction from fire is ever present. For many years, fire suppression systems which are installed in buildings have been comprised of a number of water supply lines installed above a suspended ceiling grid, the same type of grid which normally conceals other building utilities such as heating and cooling ducts, electrical supply lines and lighting fixtures, among other things. The water supply lines, in turn, are functionally adapted to supply water to sprinkler heads which are actuated by heat sensing means. This is, without question, old art.

In the experience and observations of the inventor of the present invention, the modern day suspended ceiling assembly typically consists of an array of standard 2' by 2' acoustically dampening ceiling tiles. Occasionally, the ceiling tiles are configured in a 2' by 4' tile array. Such tiles, of either the 2' by 2' or the 2' by 4' configuration, may be further constructed to give the appearance of even smaller tile configurations. That is, the 2' by 2' tiles may be sculpted to appear as though much smaller, e.g. 1' by 1' or even 6" by 6" or 3" by 3", tiles are being used. It is generally recognized that the smaller the dimension of the individual tiles, including an "apparent" smaller dimension of a larger tile which seems to be made of many smaller tiles, results in a more elegant aesthetic appearance and one which is sought after by building owners and architects alike. Another reality of modern building design is the fact that building owners and architects often specify that sprinkler heads be located on a "center of tile" basis. That is, the exact vertical centerline of the sprinkler head must protrude literally through the lengthwise and widthwise center of a given standard tile. Or, in the case of sculpted tiles, the exact vertical centerline of the sprinkler head protrudes through that part of the tile at which the center of a smaller dimensioned tile portion lies. The theory is that this "center of tile" appearance is more aesthetically pleasing and acceptable to the eye.

In the experience of this inventor, the "center of tile" requirement always increases installation costs and causes great problems for the installers of the concealed fire suppression system. One principal problem is that the "as built" placement of sprinkler heads within the ceiling array most often misses the exact "center of tile"—a situation which requires the installer of the fire suppression system to shut down and drain the fire suppression system in order to adjust the connecting supply pipes by changing their angle relative to the ceiling grid, by cutting the pipes to shorten them or by altogether removing, recutting and then reattaching them because the pipe was too short in the first instance. This is an extremely labor-intensive activity which results in higher costs and leaves an owner's property unprotected from fire while exact "center of tile" installation is pursued.

SUMMARY OF THE INVENTION

It is, therefore, a principal object of this invention to provide a new, useful and uncomplicated method and apparatus for effecting the exact "center of tile" installation of sprinkler heads in a suspended ceiling assembly which reduces installation costs and eliminates the need for repeated system shut downs. It is another object of this invention to provide such a method and apparatus which requires only a minimal number of elements and which provides means to effect this exact "center of tile" installation with a wide variety of commercially available ceiling tiles and sprinkler heads. It is yet another object of this invention to provide such a method and apparatus whereby the location of the sprinkler head can be accomplished in almost any exact "center of tile" location within such ceiling tiles while using a universal sprinkler head locating mechanism. It is still another object of the present invention to provide such a method and apparatus which allows for precise placement of the sprinkler head which requires a minimum number of steps to use in the field. It is still another object of the present invention to provide such a method and apparatus which allows for prefabrication of standard parts which are readily usable in the field throughout a wide variety of installation situations and which requires a minimum of effort on the part of the user to install them.

The present invention has obtained these objects. It provides for a fire suppression apparatus which has a sprinkler head support bracket which is installable immediately above a ceiling tile. The support bracket is configured with a plurality of openings such that multiple locations for the sprinkler head may be used and the exact "center of tile" installation of the sprinkler head can be accomplished with a wide variety of suspended ceiling assemblies and sprinkler heads. The support bracket rests on the grid support members of the ceiling tile assembly and arches over the ceiling tile. A pipe clamp is provided which is insertable within the bracket to retain a drop nipple within it. The drop nipple is adjustable relative to the horizontal to move it upwardly or downwardly relative to the ceiling tile. In this fashion, the vertical location of the sprinkler head can be adjusted depending upon the elevation of the ceiling tiles and the style of sprinkler head used. The drop nipple is attached to a flexible armover connector which allows for an almost infinite number of locations that can be used to connect the drop nipple to the supply line of the fire suppression system. The foregoing and other features of the method and apparatus of the present invention will be further apparent from the detailed description which follows.

BRIEF DESCRIPTION OF THE DRAWINGS

FIG. 1 is a perspective view looking downwardly on the grid of a typical suspended ceiling array and showing a fire suppression device constructed in accordance with the present invention and incorporated therewith.

FIG. 2 is an enlarged and partially cross-sectioned left side elevational and exploded view of the fire suppression device shown in FIG. 1.

FIG. 3 is an enlarged front and right side perspective view of the fire suppression device shown in FIG. 1.

FIG. 4 is a top plan view of the fire suppression device shown in FIG. 3.

FIG. 5 is a right side elevational view of the fire suppression device shown in FIG. 3.

DETAILED DESCRIPTION

Figure 6:
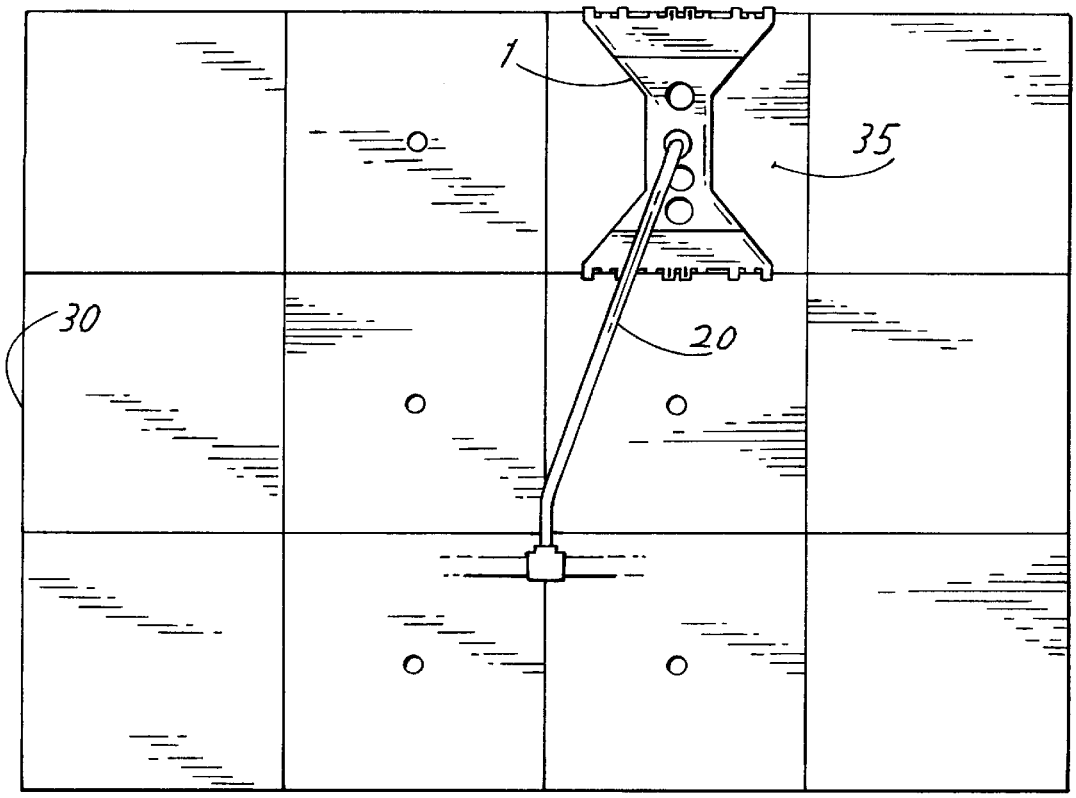
FIG. 6 is a top plan view of the fire suppression device looking downwardly on a 2' by 2' ceiling tile grid and showing various locations for the device atop the grid.

Referring now to the drawings in detail, FIG. 1 shows a fire suppression device constructed in accordance with the present invention. The preferred embodiment of the device includes a fire suppression assembly, generally identified 10, which includes a main support bracket 1. The main support bracket 1 of the assembly 10 effectively straddles or arches over a ceiling panel 35 contained within a suspended ceiling grid 30. In the preferred embodiment, the main support bracket 1 is constructed of a single piece of sheet metal material. In the experience of this inventor, a 16 gauge hot rolled sheet metal is adequate for this construction. The main support bracket 1 rests upon and is supported by the crosswise and intersecting tile support T-bars 31 of the ceiling grid 30. These tile support T-bars 31 really form the main support of the suspended ceiling array and are supported by a plurality of grid suspension wires 32. Situated immediately above the ceiling grid 30 is a main water supply line 41. The main water supply line 41, in turn, feeds a plurality of branch lines 42. It is primarily the branch lines 42 which are connected to the sprinkler heads 40 of the assembly 10. See FIG. 2.

As alluded to earlier in the specification, the connection between the branch lines 42 and the sprinkler heads 40 of the fire suppression system has heretofore been a "hard piped" connection. That is, the branch line 42 is connected to a short riser nipple pipe which is connected to an armover pipe, which is connected to a drop-down feeder pipe or drop nipple (not shown) which is connected to the sprinkler head 40. These are the pipes which are required to be disconnected, relocated, possibly re-cut, and then reattached when the exact "center of tile" installation has not been achieved upon initial installation. The fire suppression assembly 10 of the present invention includes a flexible armover 20, the qualities and features of which will be described in greater detail further in this detailed description.

The fire suppression assembly 10 also includes, starting from the bottom of the assembly (see FIG. 2) and working upwardly, a concentric reducing coupling 12, a drop nipple 15, a depth setting pipe clamp 25, and a 90° elbow 11. The concentric reducing coupling 12 essentially allows connection of the sprinkler head 40 to the bottom of the drop nipple 15. The drop nipple 15 is also threaded at its uppermost portion 16 such that it can also be attached to the 90° elbow 11. The drop nipple 15 is fuctionally adapted to be slidably received by the depth setting pipe clamp 25. The drop nipple 15 also includes pipe markings 19, the function of which will also be discussed later in this detailed description. The precise location of the drop nipple 15 within the depth setting pipe clamp 25 can be fixed by virtue of a set screw 50 which is located within the hexagonal top portion 26 of the depth setting pipe clamp 25. Immediately below the hexagonal top portion 26 of the depth setting pipe clamp 25 is a shoulder and flange portion 27. The flange portion 27 is functionally adapted to rest upon and be supported by the top surface of the central portion 5 of the main support bracket 1. The shoulder portion is received by any one of the holes 2*a*, 2*b*, 2*c*, 2*d* defined within the top portion 5 of the main support bracket 1. Extending below the shoulder portion 27 of the depth setting pipe clamp 25 is a threaded bottom portion 28. The threaded bottom portion 28 is functionally adapted to extend through any one of the holes 2*a*, 2*b*, 2*c*, 2*d* defined within the top portion 5 of the main support bracket 1. The threaded bottom portion 28 allows the depth setting pipe clamp 25 to be removably secured to the main support bracket 1 by virtue of a lock nut 24.

In the preferred embodiment, the drop nipple 15 has a series of depth-setting markings 19 defined along one side of the nipple 15 such that the location of the sprinkler head 40 can be precisely located relative to the horizontal. In the experience of the inventor, this feature allows the user to pre-set the depth of the drop nipple 15 within the pipe clamp 25 while allowing for different elevations of the ceiling tile 35 and various styles of sprinkler heads. See FIG. 5. The top or upper end 16 of the drop nipple 15 is attachable to a 90° elbow 11. The 90° elbow 11, in turn, is attachable to the second end 23 of a flexible armover 20. The other or first end 22 of the armover 20 is attachable to a branch line pipe 42 situated above the ceiling tile grid 30. In the preferred embodiment, the flexible armover 20 may be constructed of a number of commercially available flexible hoses including, but not limited to, metal, teflon, rubber, plastic or any combination of these materials. The important feature of the preferred embodiment is that the armover 20 be flexible and readily locatable relative to the main support bracket 1 without the need to disable the fire suppression system or alter any of its components.

Figure 7:
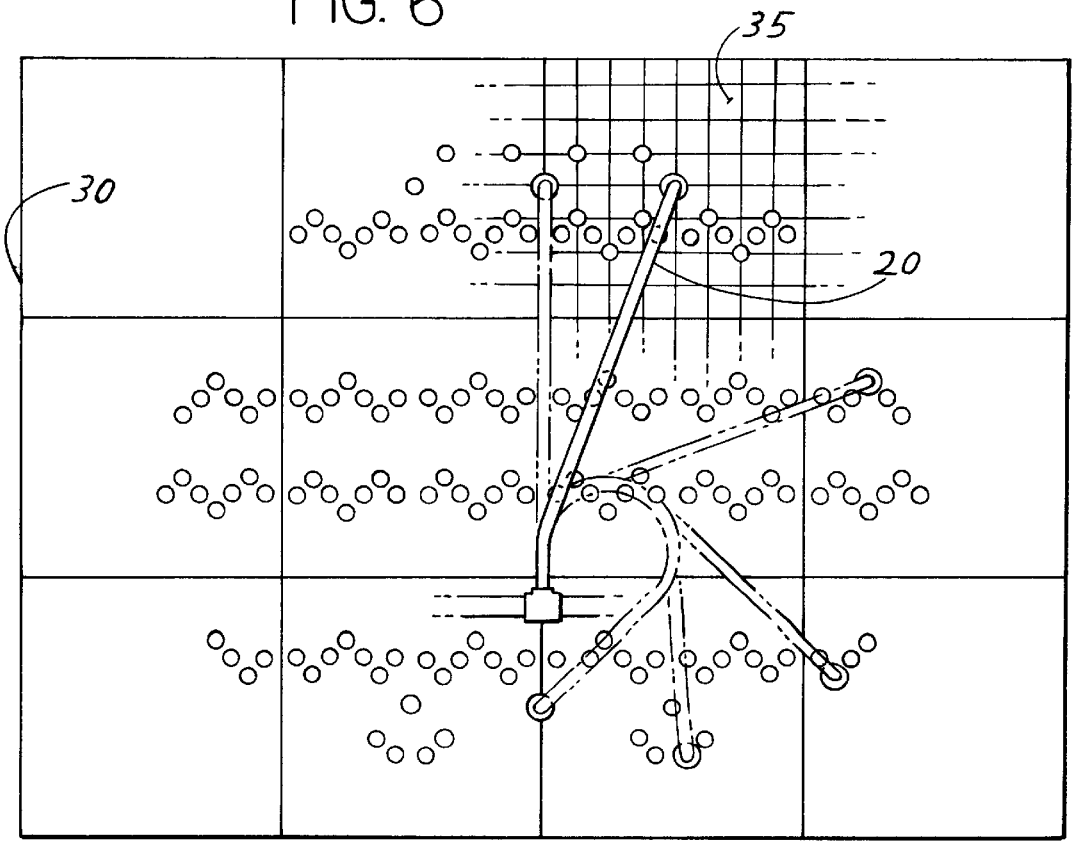
FIG. 7 is a top plan view of the fire suppression device shown in FIG. 6 and showing multiple possible locations for the device in 2' by 4', 2' by 2', 1' by 1', 6" by 6" and 3" by 3" ceiling tile configurations.

The main support bracket 1 is held in place by virtue of a plurality of hold down clips 51 which are functionally adapted to protrude through slots 9 which are defined in the outwardly extending support members 7 of the bracket 1. These hold down clips are removably attachable to the uppermost portion of the ceiling tile support T-bar 31. See FIG. 2. The location of the main support bracket 1 atop a typical 2' by 2' ceiling tile array 30 is shown in FIG. 6. As shown, at least six different locations for the bracket 1 can be achieved with a connection to a single branch line 42. Referring now to FIG. 7, it will be observed that at least fifteen (15) different locations for the bracket can be achieved within a single 2' by 2' ceiling tile 35 with a connection to a single branch line 42 and at least thirty-one (31) different bracket locations can be achieved within a single 2' by 4' ceiling tile 35. Furthermore, and in a ceiling tile array 30 in which a 2' by 4', 2' by 2', 1' by 1', 6" by 6" or 3" by 3" ceiling tile configuration is utilized, at least one hundred sixty seven (167) different locations can be realized simply by changing the selection of the different holes 2*a*, 2*b*, 2*c*, 2*d* defined within the main support bracket 1.

In application, the user of the method and apparatus of the present invention locates that portion of the ceiling grid 30 at which the "center of tile" installation is to be accomplished. It is contemplated by the inventor that the individual components of the assembly 10 reach the installer in a preassembled condition, with the exception of the main support bracket 1 and the hold down clips 51. The installer, knowing the type of ceiling tile 35 which is to be installed and also knowing the type of sprinkler head which is to be installed, sets the drop nipple 15 depth relative to the pipe clamp 25 by utilizing the pre-printed markings 19 on the drop nipple 15. The pipe clamp 25 is then secured within one of the holes 2*a*, 2*b*, 2*c*, 2*d* of the support bracket 1 and the assembly 10, including the bracket 1, is connected to the branch line 42. The entire assembly 1 is then secured and held in place above the grid 30 by use of a nylon strap (not shown). In this fashion, the assembly 10 is out of the way and ready for hydrostatic testing. Following testing of the fire suppression system, the ceiling tile installer comes in to install the ceiling tiles 35 which is followed by the fire suppression system installer coming back to set the brackets 1 on top of those ceiling tiles 35 which are to receive the sprinkler heads 40 according to design. In the preferred embodiment, the bracket 1 relies upon a plurality of outwardly extending support members 7 and upon a plurality of downwardly extending support members 8, both sets of which extend from the legs 6 of the main support bracket 1, to support it. See FIG. 2. Finally, two or four hold down clips 51 are then installed which protrude through slots 9 in four of the outwardly extending support members 7 of the main support bracket 1 (see FIGS. 2 and 5) and attach to the ceiling tile support T-bars 31. The number of hold down clips is determined by the type of sprinkler head 40 used and the maximum system pressure provided. Twisting of the flexible armover 20 is avoided and the bracket 1 remains in place. It is also to be emphasized that the ceiling tile pattern provided, e.g. 24"×48"; 24"×24"; 12"×12"; 6"×6"; 3"×3", determines which of the plurality of holes 2*a*, 2*b*, 2*c*, 2*d* defined within the top portion 5 of the main support bracket 1 will be used for locating the depth setting pipe clamp 25 therewithin. That is, the user will have a plurality of holes 2*a*, 2*b*, 2*c*, 2*d* from which to select when locating the pipe clamp 25 within the top portion 5 of the main support bracket 1. This feature is also one which allows for accurate pre-setting of the pipe clamp 25 within the bracket 1 when the installer knows which ceiling tile configuration is used. Rotation of the bracket 1 by 180° allows for a wide variety of hole selections within the bracket 1 to accomplish this.

From the foregoing, it will be apparent that there has been provided a new, useful and uncomplicated method and apparatus for effecting the exact"center of tile" installation of sprinkler heads in a suspended ceiling tile grid, which apparatus requires only a minimal number of elements; which provides means to effect this exact "center of tile" installation with a wide variety of commercially available ceiling tiles and sprinkler heads and where the location of the sprinkler head can be accomplished in almost any exact "center of tile" location within such ceiling tiles while using a universal sprinkler head locating bracket; which allows for exact placement of the sprinkler head while requiring a minimum number of steps to use in the field; which allows for prefabrication of standard parts which are readily usable in the field throughout a wide variety of installation situations and which requires a minimum of effort on the part of the user to install them, all at a reduced cost.

The principles of this invention having been fully explained in connection with the foregoing, I hereby claim as my invention:

1. For use in a fire suppression system, said system being located at and above a grid of like-dimensioned ceiling tiles and ceiling tile support T-bars and having at least one fixed fluid supply line and a plurality of sprinkler heads for dispersing fluid at and below said ceiling tile grid, an apparatus for locating sprinkler heads within a ceiling tile grid which comprises means for locating a sprinkler head at the exact center of the dimensional profile of a ceiling tile contained within the grid, said sprinkler head locating means comprising a sprinkler head support bracket which is functionally adapted to overlay a ceiling tile within the grid and to be supported by two opposing ceiling tile support T-bars to either side of said tile, said sprinkler head support bracket including a plurality of holes defined within said bracket, said holes corresponding to the exact center of the dimensional profile of a ceiling tile, means for adjustably setting the depth of the sprinkler head relative to said ceiling tile, and a flexible hose connecting the sprinkler head to said fixed fluid supply line.

2. The sprinkler head locating apparatus of claim 1 wherein said depth setting means includes a drop nipple connected to said sprinkler head and further includes a drop nipple pipe clamp which is functionally adapted to be supported within any one of the holes defined within said sprinkler head support bracket, said drop nipple being movable within said drop nipple pipe clamp whereby the position of the sprinkler head may be variably adjusted relative to the ceiling tile.

3. The sprinkler head locating apparatus of claim 2 wherein said flexible hose comprises a metallic hose with a braided metallic sleeve.

4. The sprinkler head locating apparatus of claim 3 wherein said flexible hose comprises a rubber hose.

5. The sprinkler head locating apparatus of claim 1 wherein said ceiling tile is comprised of like-dimensioned geometrical subdivisions and said sprinkler head locating means further includes means for locating a sprinkler head at the exact center of any of such geometrical subdivisions, said sprinkler head locating means comprises a sprinkler head support bracket which is functionally adapted to overlay a ceiling tile within the grid and to be supported by two opposing ceiling tile support T-bars to either side of said tile, and said sprinkler head support bracket includes a plurality of holes defined within said bracket, said holes corresponding to the exact centers of the geometrical subdivisions of said ceiling tile.

6. The sprinkler head locating apparatus of claim 5 wherein said depth setting means includes a drop nipple which is functionally adapted to be connectable to a sprinkler head and further includes a drop nipple pipe clamp which is functionally adapted to be supported within any one of the holes defined within said sprinkler head support bracket, said drop nipple being movable within said drop nipple pipe clamp whereby the position of the sprinkler head may be variably adjusted relative to the ceiling tile.

7. The sprinkler head locating apparatus of claim 6 wherein said flexible hose comprises a metallic hose with a braided metallic sleeve.

8. The sprinkler head locating apparatus of claim 7 wherein said flexible hose comprises a rubber hose.

9. A method for locating sprinkler heads used in a fire suppression system, said system being located at and above a grid of like-dimensioned ceiling tiles and ceiling tile support T-bars and having at least one fixed fluid supply line and a plurality of sprinkler heads for dispersing fluid at and below said ceiling grid, which comprises the steps of providing a means for locating a sprinkler head at the exact center of the dimensional profile of a ceiling tile contained within the grid, providing a ceiling tile having like-dimensioned geometrical subdivisions, locating a sprinkler head at the exact center of any of such geometrical subdivisions, said sprinkler head locating step comprises providing a sprinkler head support bracket which is functionally adapted to overlay a ceiling tile within the grid to be supported by two opposing ceiling tile support T-bars to either side of said tile, said support bracket having a plurality of holes defined within said bracket which correspond to the exact center of the dimensional profile of a ceiling tile and which correspond to the exact centers of the geometrical subdivisions of said ceiling tiles providing means for adjustably setting the depth of the sprinkler head relative to said ceiling tile, and providing a flexible hose for connecting the sprinkler head to said fixed fluid supply line.

10. The method of claim 9 wherein said depth setting means providing step includes providing a drop nipple and connecting said drop nipple to said sprinkler head and further includes providing a drop nipple pipe clamp, said drop nipple pipe clamp being functionally adapted to be supported within any one of the holes defined within said sprinkler head bracket, said drop nipple being movable within said drop nipple pipe clamp whereby the position of the sprinkler head may be variably adjusted relative to the ceiling tile.

11. The method of claim 10 wherein said hose providing step includes providing a metallic hose with a braided metallic sleeve.

12. The method of claim 11 wherein said hose providing step includes providing a rubber hose.

* * * * *